US010724344B2

(12) United States Patent
Dietz

(10) Patent No.: US 10,724,344 B2
(45) Date of Patent: Jul. 28, 2020

(54) SHIFTABLE ISOLATION SLEEVE FOR MULTILATERAL WELLBORE SYSTEMS

(71) Applicant: Halliburton Energy Services, Inc., Houston, TX (US)

(72) Inventor: Wesley P. Dietz, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 325 days.

(21) Appl. No.: 15/760,216

(22) PCT Filed: Oct. 29, 2015

(86) PCT No.: PCT/US2015/057961

§ 371 (c)(1),
(2) Date: Mar. 14, 2018

(87) PCT Pub. No.: WO2017/074376

PCT Pub. Date: May 4, 2017

(65) Prior Publication Data

US 2018/0252075 A1 Sep. 6, 2018

(51) Int. Cl.

| | |
|---|---|
| ***E21B 41/00*** | (2006.01) |
| ***E21B 7/06*** | (2006.01) |
| ***E21B 23/00*** | (2006.01) |

(52) U.S. Cl.

CPC ..... *E21B 41/0035* (2013.01); *E21B 7/061* (2013.01); *E21B 23/00* (2013.01)

(58) Field of Classification Search

CPC ..... E21B 7/061; E21B 41/0035
See application file for complete search history.

(56) References Cited

U.S. PATENT DOCUMENTS 5,154,231 A 10/1992 Bailey et al.
5,615,740 A 4/1997 Comeau et al.
(Continued)

FOREIGN PATENT DOCUMENTS

GB 2382369 A 5/2003

OTHER PUBLICATIONS

DeMong et al., "The Application of Pressure Isolated Multilateral Junction Iproves Economics in Offshore Arabian Gulf," IADC/SPE 77201, 2002, 10 pages.
(Continued)

*Primary Examiner* — Kristyn A Hall
(74) *Attorney, Agent, or Firm* — Scott Richardson; C. Tumey Law Group PLLC

(57) ABSTRACT

A well system having primary and secondary wellbores wherein a completion sleeve is positioned in the primary wellbore and defines a window aligned with a primary wellbore casing exit and upper and lower couplings defined on opposing axial ends of the window. An isolation sleeve is positioned within the completion sleeve and defines a helical slot. The isolation sleeve is movable between a first position, where a engagement device engages the upper coupling and the isolation sleeve occludes the window, and a second position, where the isolation sleeve is moved axially within completion sleeve to expose the window and the engagement device engages the lower coupling. A whipstock assembly includes a latch key that selectively locates and engages an inner profile of the isolation sleeve to move the isolation sleeve to the second position. An orienting key mates with the helical slot to angularly orient the whipstock assembly.

19 Claims, 7 Drawing Sheets

(56) References Cited

U.S. PATENT DOCUMENTS

| | | | | |
|---|---|---|---|---|
| 5,785,133 | A | 7/1998 | Murray et al. | |
| 6,015,012 | A | 1/2000 | Reddick | |
| 6,497,288 | B2 | 12/2002 | George et al. | |
| 6,766,859 | B2 | 7/2004 | Haugen et al. | |
| 8,678,092 | B2 | 3/2014 | Assal et al. | |
| 2003/0192717 | A1 | 10/2003 | Smith et al. | |
| 2013/0068453 | A1 | 3/2013 | Al-Ajaji et al. | |
| 2014/0008130 | A1 | 1/2014 | Dancer et al. | |
| 2014/0345876 | A1* | 11/2014 | Coon | E21B 34/14 166/373 |

OTHER PUBLICATIONS

International Search Report and Written Opinion from PCT/US2015/057961, dated Jul. 29, 2016, 16 pages.

* cited by examiner

SHIFTABLE ISOLATION SLEEVE FOR MULTILATERAL WELLBORE SYSTEMS

BACKGROUND

In the oil and gas industry, hydrocarbons are produced from wellbores traversing subterranean hydrocarbon producing formations. Many current well completions include more than one wellbore. For example, a first, generally vertical wellbore may be initially drilled within or adjacent to one or more hydrocarbon producing formations. Any number of additional wellbores may then be drilled extending generally laterally away from the first wellbore to respective locations selected to optimize production from the associated hydrocarbon producing formation or formations. Such well completions are commonly referred to as multilateral wells.

A typical multilateral well completion includes a primary wellbore defined in part by a string of casing and cement disposed between the casing and the inside diameter of the primary wellbore. The primary wellbore extends from the well surface to a desired downhole location, and directional drilling equipment and techniques may then be used to form one or more exits or windows from the primary wellbore through the casing and cement at predetermined locations and subsequently drill one or more corresponding secondary wellbores that extend from the primary wellbore. For many well completions such as deep offshore wells, multiple secondary wellbores will be drilled from each primary wellbore in an effort to optimize hydrocarbon production while minimizing overall drilling and well completion costs.

Selective isolation and/or reentry into each of the secondary wellbores is often necessary to optimize production from the associated hydrocarbon producing formations. A typical multilateral well completion will have a reentry window assembly (alternately referred to as a lateral reentry window) installed within the primary wellbore at the junction between the primary wellbore and each secondary wellbore. Each reentry window assembly includes a window that provides access into the secondary wellbore from the primary wellbore. An isolation sleeve is arranged within the reentry window assembly and is selectively movable to cover or expose the window. To enter the secondary wellbore, the isolation sleeve is located and moved axially within the reentry window assembly to expose the window and allow access into the secondary wellbore.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to multilateral wellbore operations and, more particularly, to an isolation sleeve that can be shifted open to allow access to a secondary wellbore from a primary wellbore and subsequently shifted closed to isolate the secondary wellbore from the primary wellbore.

Embodiments described herein reduce the number of required intervention trips into a multilateral well to perform maintenance on a secondary wellbore extending from a primary wellbore. A shiftable isolation sleeve is described herein and able to move between a closed position, where the isolation sleeve isolates a secondary wellbore, and an open position, where the isolation sleeve exposes the secondary wellbore and allows downhole tools to access the secondary wellbore. The isolation sleeve may be shifted to the open position when installing a whipstock assembly in the primary wellbore and may define a helical slot used to angularly orient the whipstock assembly to a casing exit so that downhole tools may be deflected into the secondary wellbore via the whipstock assembly. Following intervention in the secondary wellbore, the isolation sleeve may be shifted back to the closed position while pulling the whipstock assembly out of the primary wellbore. The embodiments described herein allow a well operator to stack multiple reentry window assemblies in a multilateral well without having to pull and retrieve upper isolation sleeves to access the lower secondary wellbores, or from having telescoping isolation sleeves where lower isolation sleeves are smaller than the upper isolation sleeves.

Figure 1:
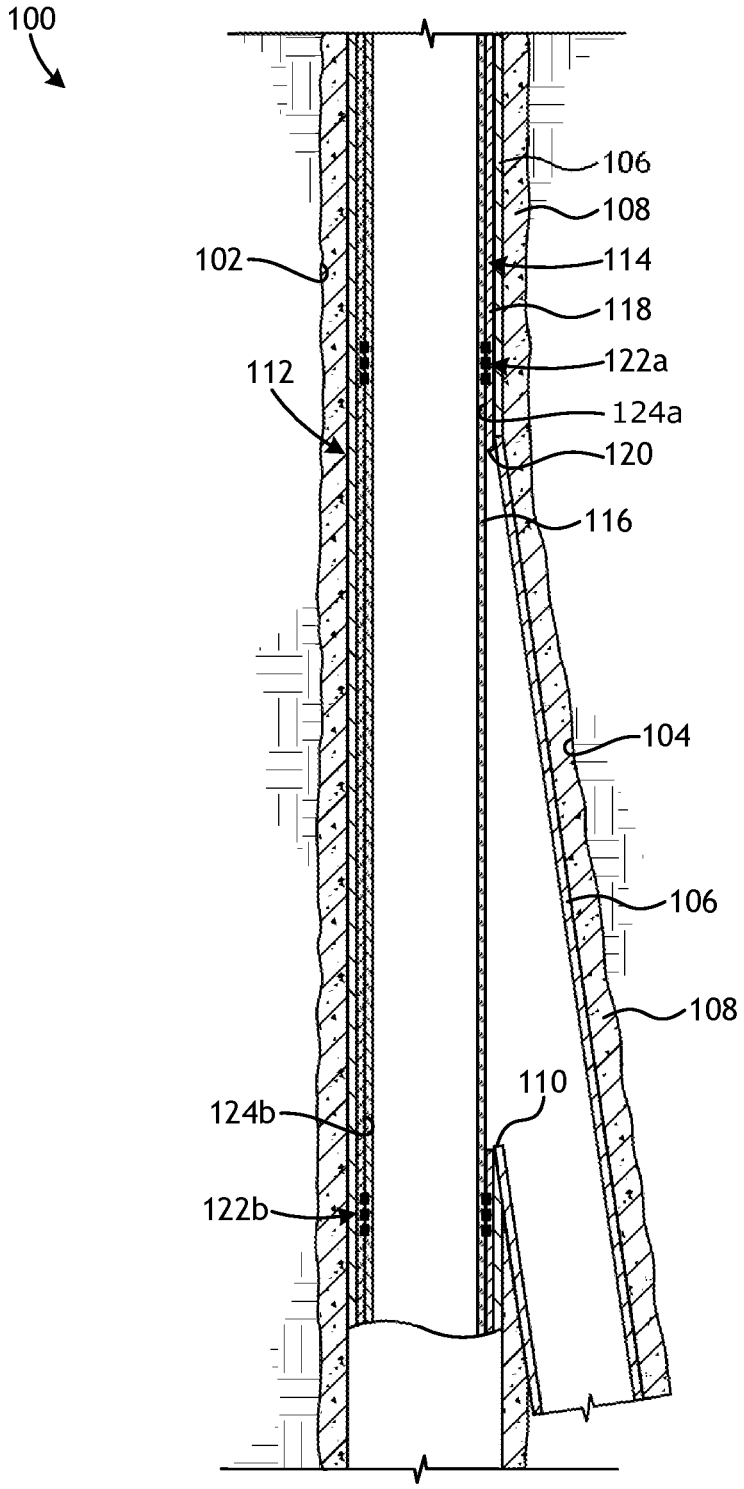
FIG. 1 is a cross-sectional side view of an exemplary well system that may incorporate the principles of the present disclosure.

FIG. 1 is a cross-sectional side view of an exemplary well system 100 that may incorporate the principles of the present disclosure, according to one or more embodiments. As illustrated, the well system 100 may include a primary wellbore 102 and a secondary wellbore 104 that extends at an angle from the primary wellbore 102. The primary wellbore 102 can alternately be referred to as a parent wellbore, and the secondary wellbore 104 can be referred to as a lateral wellbore. While only one secondary wellbore 104 is depicted in FIG. 1, it will be appreciated that the well system 100 may include multiple secondary (lateral) wellbores 104 extending from the primary wellbore 102 at various locations. Accordingly, the well system 100 may be characterized and otherwise referred to as a "multilateral" wellbore system.

A liner or casing 106 may line each of the primary and secondary wellbores 102, 104 and cement 108 may be used to secure the casing 106 therein. In some embodiments, however, the casing 106 may be omitted from the secondary wellbore 104, without departing from the scope of the disclosure. The primary and secondary wellbores 102, 104, may be drilled and completed using conventional well drilling techniques. A casing exit 110 may be milled, drilled, or otherwise defined along the casing 106 at the junction between the primary and secondary wellbores 102, 104. The casing exit 110 generally provides access for downhole tools to enter the secondary wellbore 104 from the primary wellbore 102.

In the illustrated embodiment, the well system 100 has been completed by installing a reentry window assembly 112 in the primary wellbore 102. The reentry window assembly 112 includes a completion sleeve 114 and an isolation sleeve 116 movably positioned within the interior of the completion sleeve 114. As illustrated, the completion sleeve 114 is able to be positioned within the primary wellbore 102 and provides a generally cylindrical body 118 that axially spans the casing exit 110. The completion sleeve 114 may be arranged within the primary wellbore 102 such that a window 120 defined in the completion sleeve 114 azimuthally and angularly aligns with the casing exit 110 and thereby provides access into the secondary wellbore 104 from the primary wellbore 102.

The isolation sleeve 116 may be positioned within the body 118 of the completion sleeve 114 and may comprise a generally tubular or cylindrical structure that is axially movable within the completion sleeve 114 between a first or "closed" position and a second or "open" position. FIG. 1 depicts the isolation sleeve 116 in the first position, where the isolation sleeve 116 occludes (covers) the window 120 and thereby prevents access into the secondary wellbore 104 from the primary wellbore 102. In the second position, the isolation sleeve 116 is moved axially within the body 118 to expose the window 120 and thereby allow downhole tools to access the secondary wellbore 104.

In some embodiments, as in the example of FIG. 1, a set of upper seals 122*a* and a set of lower seals 122*b* are provided to seal between the completion sleeve 114 and the isolation sleeve 116. The upper seals 122*a* and the lower seals 122*b* are optionally carried on the isolation sleeve 116. The upper seals 122*a* may sealingly engage an upper seal bore 124*a* provided on the inner surface of the body 118, and the lower seals 122*b* may sealingly engage a lower seal bore 124*b* provided on the inner surface of the body 118. As illustrated, the upper and lower seal bores 124*a,b* are located adjacent opposing axial ends of the window 120. Accordingly, when in the first position, the isolation sleeve 116 may provide fluid isolation between the primary and secondary wellbores 102, 104.

Figure 2:
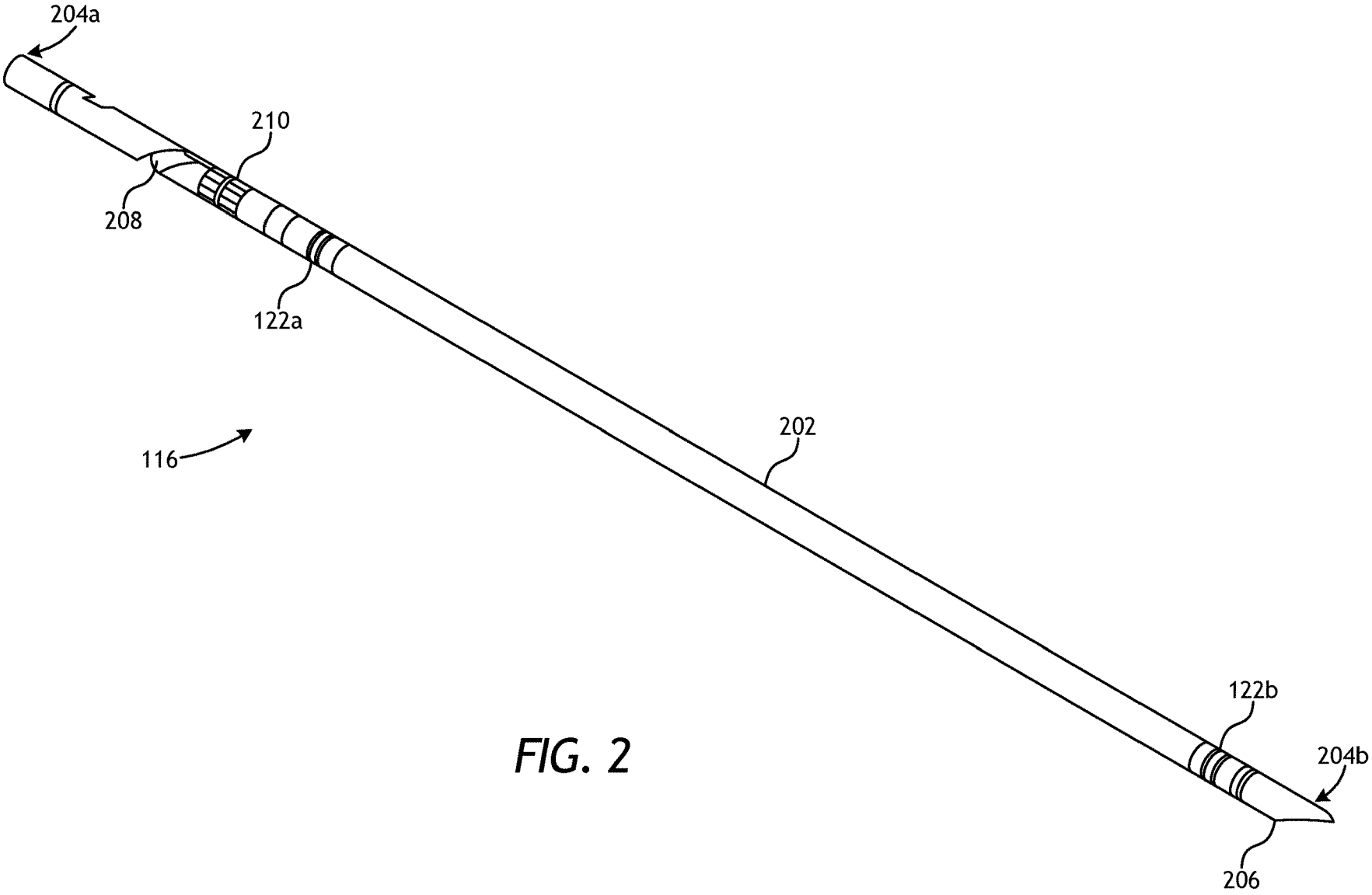
FIG. 2 is an isometric view of the isolation sleeve of FIG. 1.

FIG. 2 is an isometric view of the isolation sleeve 116 of FIG. 1. As illustrated, the isolation sleeve 116 includes an elongate and generally cylindrical body 202 having a first or "uphole" end 204*a* and a second or "downhole" end 204*b*. An orienting muleshoe 206 may be provided at the second end 204*b* and may be used to angularly orient the isolation sleeve 116 within the completion sleeve 114 (FIG. 1), as described below. A helical slot 208 may be defined in the body 202 at or near the first end 204*a*. As described below, the helical slot 208 may be configured to help angularly orient a whipstock assembly (not shown) to the window 120 (FIG. 1) of the completion sleeve 114 so that tools can be accurately deflected into the secondary wellbore 104 (FIG. 1) via the window 120.

An engagement device 210 may also be provided on the body 202 at or near the first end 204*a*. As described below, the engagement device 210 may be configured to releasably secure the isolation sleeve 116 at the first and second positions within the completion sleeve 114 (FIG. 1). In at least one embodiment, the engagement device 210 may comprise a snap collet that includes a plurality of flexible collet fingers. In other embodiments, however, the engagement device 210 may comprise any type of mechanism capable of releasably engaging the completion sleeve 114. Lastly, the sets of upper and lower seals 122*a,b* are depicted as being axially spaced from each other along the body 202. As will be appreciated, the axial distance between the upper and lower seals 122*a,b* is sufficient to axially span the window 120 (FIG. 1) of the completion sleeve 114 and thereby sealingly engage the upper and lower seal bores 124*a,b* (FIG. 1), respectively.

Figure 3A:
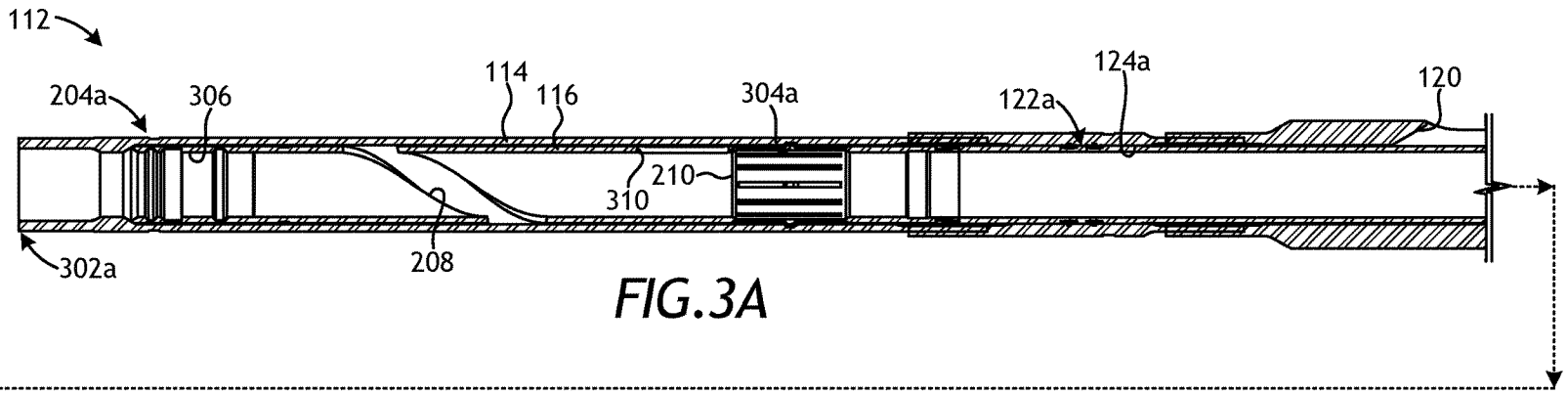
FIGS. 3A-3C are successive cross-sectional side views of the assembly of FIG. 1.
Figure 3B:
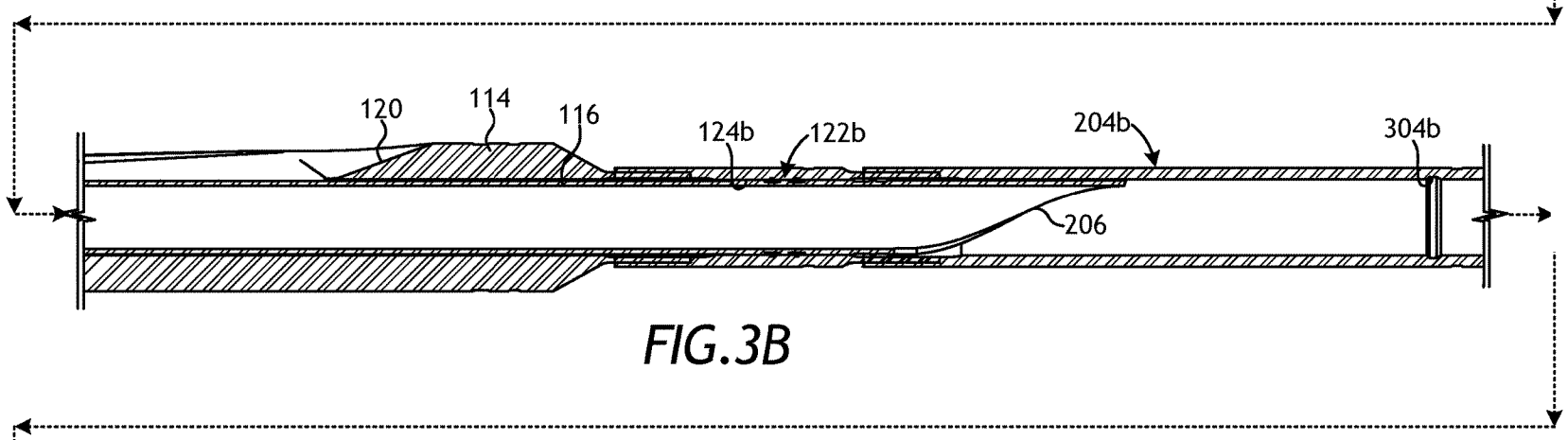
Figure 3C:
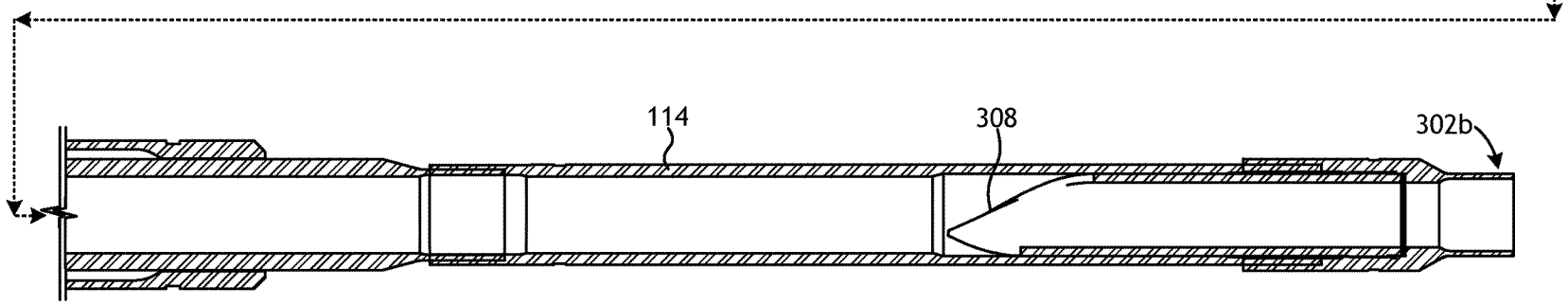

FIGS. 3A-3C are successive cross-sectional side views of the reentry window assembly 112 of FIG. 1, according to one or more embodiments. More particularly, FIG. 3A depicts an upper portion of the reentry window assembly 112, FIG. 3B depicts a successive intermediate portion of the reentry window assembly 112, and FIG. 3C depicts a successive lower portion of the reentry window assembly 112. Sections of the reentry window assembly 112 between the upper and intermediate portions and between the intermediate and lower portions not required for the present discussion are omitted. Similar reference numerals used in prior figures will refer to similar elements or components that may not be described again in detail.

As illustrated, the isolation sleeve 116 is depicted as being positioned within the interior of the completion sleeve 114. The upper and lower seals 122*a,b* are shown in sealing engagement with the upper and lower seal bores 124*a,b*, respectively, and located adjacent opposing axial ends of the window 120.

The completion sleeve 114 provides an upper end 302*a*, as shown in FIG. 3A, and a lower end 302*b*, as shown in FIG. 3C. The isolation sleeve 116 is shown in FIGS. 3A-3C in the first position, where the isolation sleeve 116 is arranged within the completion sleeve 114 near the upper end 302*a*. The isolation sleeve 116 may be secured in the first position by locating and receiving the engagement device 210 in an upper coupling 304*a* provided on the inner radial surface of the completion sleeve 114 near the upper end 302*a*. To move the isolation sleeve 116 to the second position, as described below, the engagement device 210 disengages the upper coupling 304*a* and is moved in the downhole direction (i.e., to the right in FIGS. 3A-3C) until being received by a lower coupling 304*b* (FIG. 3B) also defined on the inner radial surface of the completion sleeve 114.

In some embodiments, as illustrated, one or both of the upper and lower couplings 304*a,b* may comprise grooves, indentations, protrusions, or profiles defined on the inner radial surface of the completion sleeve 114. In other embodiments, one or both of the upper and lower couplings 304*a,b* may include, but are not limited to, a retractable snap ring, a shear ring, a magnetic engagement, or the like. As will be appreciated, the upper and lower couplings 304*a,b* may comprise any device or mechanism that allows the engagement device 210 to receive and releasably couple thereto, depending primarily on the specific design of the engagement device 210.

The isolation sleeve 116 may further provide an inner profile 306 defined on its inner radial surface at or near its uphole end 204*a*. The inner profile 306 may provide a unique pattern configured to receive a selective latch key of a whipstock assembly. In some embodiments, for example, a plurality of isolation sleeves similar in some respects to the isolation sleeve 116 may be employed in a particular multilateral well system (e.g., the well system 100 of FIG. 1) with a corresponding plurality of completion sleeves arranged in a stacked configuration at corresponding junctions between the primary wellbore 102 (FIG. 1) and associated secondary wellbores. In such embodiments, a whipstock assembly conveyed downhole may be configured to selectively latch into and move only a desired isolation sleeve based on the unique pattern of the inner profile 306, and bypass the other isolation sleeves.

A muleshoe 308 may be provided and otherwise defined at or near the downhole end 302*b* of the completion sleeve 114. The completion sleeve 114 may be secured within the primary wellbore 102 (FIG. 1) such that the muleshoe 308 is positioned to engage and angularly orient the isolation sleeve 116 to a desired angular orientation within the completion sleeve 114, and thereby help orient a whipstock assembly so that it angularly aligns with the window 120. More particularly, the muleshoe 308 may be configured to receive the orienting muleshoe 206 as the isolation sleeve 116 moves in the downhole direction (i.e., to the right in FIGS. 3A-3C) and to the second position. The muleshoe 308 provides a curved uphole surface configured to slidingly engage a corresponding curved downhole surface of the orienting muleshoe 206. Sliding engagement between the opposing curved surfaces as the isolation sleeve 116 moves in the downhole direction will urge the isolation sleeve 116 to rotate within the completion sleeve 114 to a desired angular orientation.

The helical slot 208 is depicted in FIG. 3A and may extend at least a full 360° about the body 202 (FIG. 2) of the isolation sleeve 116. At its downhole end, the helical slot 208 terminates in a straight portion 310. As described below, the helical slot 208 may be configured to receive an orienting key (not shown) of a whipstock assembly that slidingly engages the helical slot 208 and simultaneously rotates the whipstock assembly to a desired angular orientation. The orienting key may advance along the helical slot 208 until reaching the straight portion 310, which ultimately places the whipstock assembly in the desired orientation.

Figure 4A:
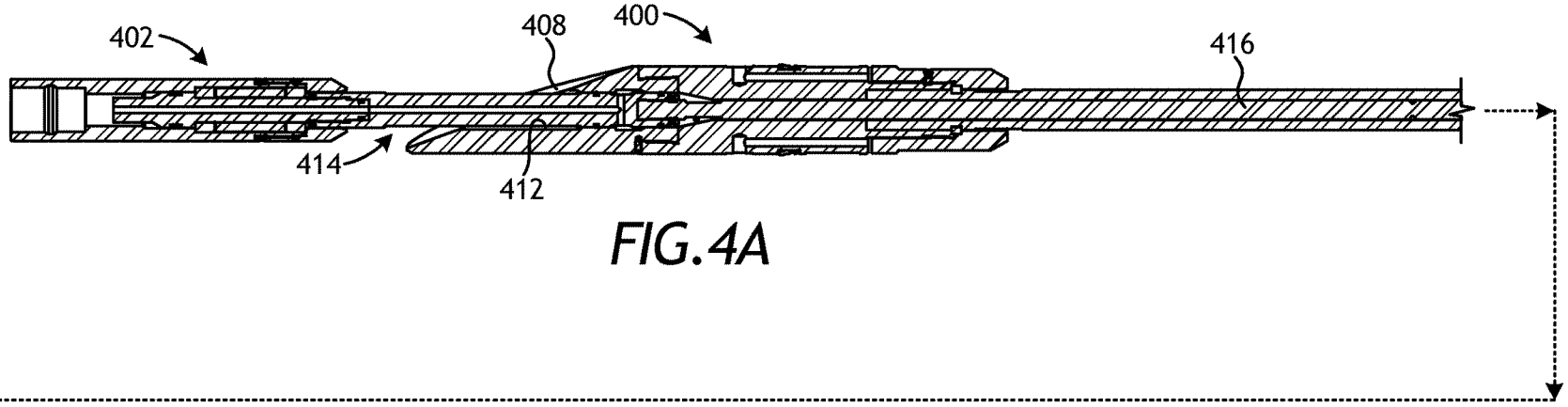
FIGS. 4A and 4B are successive enlarged views of an exemplary whipstock assembly and the upper portion of the assembly of FIG. 1.
Figure 4B:
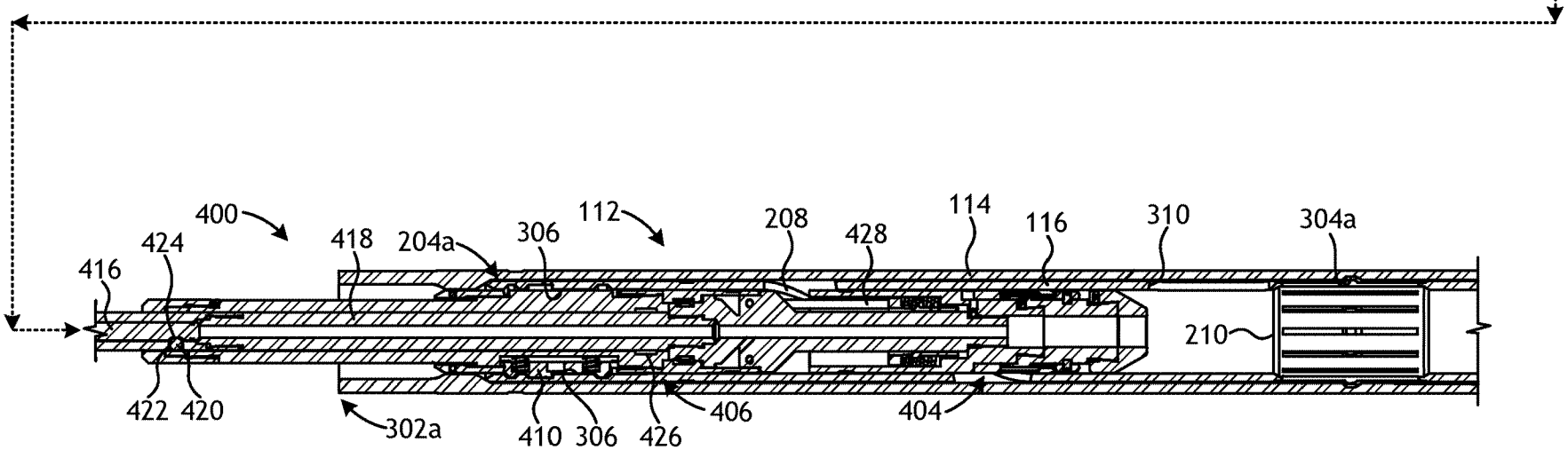

FIGS. 4A and 4B are successive enlarged views of an exemplary whipstock assembly 400 and the upper portion of the reentry window assembly 112, according to one or more embodiments. To be able to access the secondary wellbore 104 (FIG. 1), a running tool 402 may be coupled to and advance the whipstock assembly 400 within the primary wellbore 102 (FIG. 1) until locating the reentry window assembly 112. The running tool 402 may be operatively coupled at its uphole end to wireline or coiled tubing, for example, which serves to convey the running tool 402 and the coupled whipstock assembly 400 downhole. The whipstock assembly 400 may be configured to "sting into" and otherwise enter the interior of the completion sleeve 114 at the upper end 302*a* and advance into the isolation sleeve 116 to couple to the isolation sleeve 116. Once properly coupled to the isolation sleeve 116, as described below, the whipstock assembly 400 may then be advanced further downhole to axially move the isolation sleeve 116 to the second position, which exposes the window 120 (FIGS. 1 and 3A-3B) and provides access into the secondary wellbore 104.

The running tool 402 may be operatively coupled to a jarring device or jarring tool at its uphole end. The jarring tool may be configured to jar down or up on the running tool 402 to advance or retract the whipstock assembly 400 in the reentry window assembly 112. As used herein, the phrases "jarring down" and "jarring up," and variations thereof, refer to the jarring tool generating an axial impulse load that is transferred to the running tool 402 and, therefore, to the whipstock assembly 400 and the isolation sleeve 116. In particular, "jarring up" means that an upward impulse force is applied to the running tool 402 and the whipstock assembly 400, and "jarring down" means that a downward impulse force is applied to the running tool 402 and the whipstock assembly 400. Once properly positioned within the reentry window assembly 112, the whipstock assembly 400 may operate to deflect downhole tools out of the window 120 (FIGS. 1 and 3A-3B) of the completion sleeve 114 and into the secondary wellbore 104 (FIG. 1). Accordingly, the whipstock assembly 400 may be characterized and otherwise referred to as a tubing exit whipstock or "TEW".

As illustrated, the whipstock assembly 400 may include a bullnose assembly 404, a latch key assembly 406, and a whipstock face 408. The bullnose assembly 404 may be received within the completion sleeve 114 at the upper end 302*a* and extend into the isolation sleeve 116 at its uphole end 204*a*. The bullnose assembly 404 may be operatively coupled to the latch key assembly 406 and may advance in the downhole direction until the latch key assembly 406 mates with the inner profile 306. More particularly, the latch key assembly 406 may include a selective latch key 410 with a unique profile design that selectively locates and engages the inner profile 306. In some embodiments, the selective latch key 410 may be spring-loaded and thereby able to snap into and out of engagement with the inner profile 306 under sufficient axial load. It is noted that because of its unique profile design, the spring-loaded latch key 410 may be configured to bypass inner profiles of other isolation sleeves that do not match the unique pattern of the inner profile 306. As will be appreciated, this may allow a well operator to employ multiple stacked assemblies 112 within a multilateral well system.

The whipstock face 408 may comprise a slanted or angled surface configured to engage and divert downhole tools into the secondary wellbore 104 (FIG. 1) when the isolation sleeve 116 is secured in the second position. The whipstock face 408 may further define a central passage 412 configured to receive a mandrel assembly 414 of the running tool 402. The mandrel assembly 414 includes an actuation mandrel 416 that axially engages the upper end of a latch key mandrel 418. The latch key mandrel 418 extends longitudinally through a bore defined in the latch key assembly 406 and operatively couples the latch key assembly 406 to the bullnose assembly 404. As a result, downhole axial movement of the latch key mandrel 418 with respect to the latch key assembly 406 will correspondingly move the bullnose assembly 404 downhole with respect to the latch key assembly 406.

The actuation mandrel 416 operatively couples the running tool 402 to the whipstock assembly 400. More particularly, the actuation mandrel 416 is secured in its axial position with a ball 420 positioned within a slot 422 defined in an axial extension of the latch key assembly 406. The ball 420 may be radially engaged with a groove 424 defined on the distal end of the actuation mandrel 416 and thereby locks the axial position of the actuation mandrel 416 with respect to the latch key assembly 406. As will be discussed below, the actuation mandrel 416 may be actuated in the downhole direction and thereby correspondingly move the latch key mandrel 418 and the bullnose assembly 404 downhole with respect to the latch key assembly 406. The actuation mandrel 416 may be moved axially downhole until the ball 420 is eventually received within a pocket 426 defined within the latch key assembly 406. Once the ball 420 is received within the pocket 426, the ball 420 falls out of radial engagement with the groove 424 and thereby frees the actuation mandrel 416 and, therefore, frees the running tool 402 from coupled engagement with the whipstock assembly 400.

The whipstock assembly 400 may further include an orienting key 428 (partially visible in FIG. 4B) that is operatively coupled to the bullnose assembly 404 and extends longitudinally therefrom. The orienting key 428 is movable between a stowed configuration and a radially extended configuration. FIG. 4B depicts the orienting key 428 in the stowed configuration, where the orienting key 428 is maintained radially contracted so that the whipstock assembly 400 can axially traverse the primary wellbore 102 (FIG. 1) and enter the reentry window assembly 112 without the orienting key 428 catching on radial surfaces of the primary wellbore 102 or the reentry window assembly 112. Upon actuation of the actuation mandrel 416, however, the orienting key 428 may be unsheathed and otherwise able to expand radially outward and locate the helical slot 208. The orienting key 428 may then be configured to slidingly engage the helical slot 208 to angularly orient the whipstock assembly 400 until reaching the straight portion 310. Once the orienting key 428 advances to the straight portion 310, angular rotation of the whipstock assembly 400 ceases and the whipstock face 408 will be properly aligned with the window 120 (FIGS. 1 and 3A-3B) of the completion sleeve 114.

With the whipstock assembly 400 latched into the isolation sleeve 116 at the inner profile 306, the running tool 402 can be used and otherwise actuated to shift the isolation sleeve 116 in the downhole direction (i.e., to the right in FIGS. 4A and 4B) and thereby move the isolation sleeve 116 to the second or open position. To accomplish this, the running tool 402 may place an axial load on the isolation sleeve 116 to disengage the engagement device 210 from the upper coupling 304*a*. In some embodiments, the axial load required to disengage the engagement device 210 from the upper coupling 304*a* may result from downward jarring on the running tool 402 with a jarring tool operatively coupled to the running tool 402. In other embodiments, the axial load required to disengage the engagement device 210 from the upper coupling 304*a* may be provided by placing weight on a conveyance (e.g., drill pipe, coiled tubing, production tubing, etc.) that runs the whipstock assembly 400 downhole. Once the engagement device 210 is disengaged from the upper coupling 304*a*, additional axial load (e.g., downward jarring) on the running tool 402 may advance the isolation sleeve 116 within the completion sleeve 114 in the downhole direction until the isolation sleeve 116 is moved to the second position.

Figure 5A:
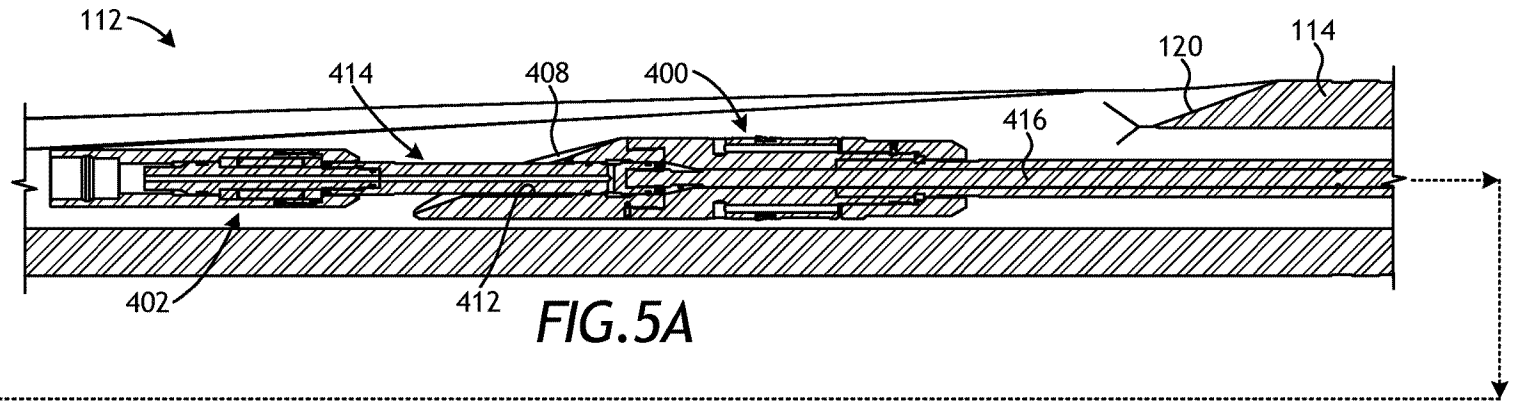
FIGS. 5A-5C are successive cross-sectional side views of the assembly of FIG. 1 showing the isolation sleeve moved to the second position.
Figure 5B:
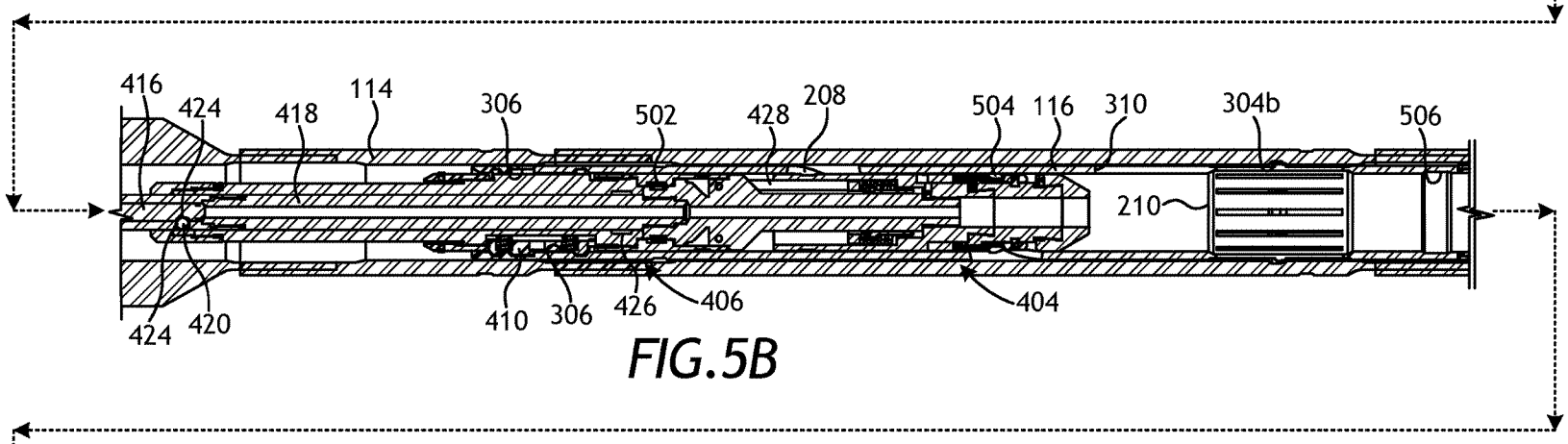
Figure 5C:
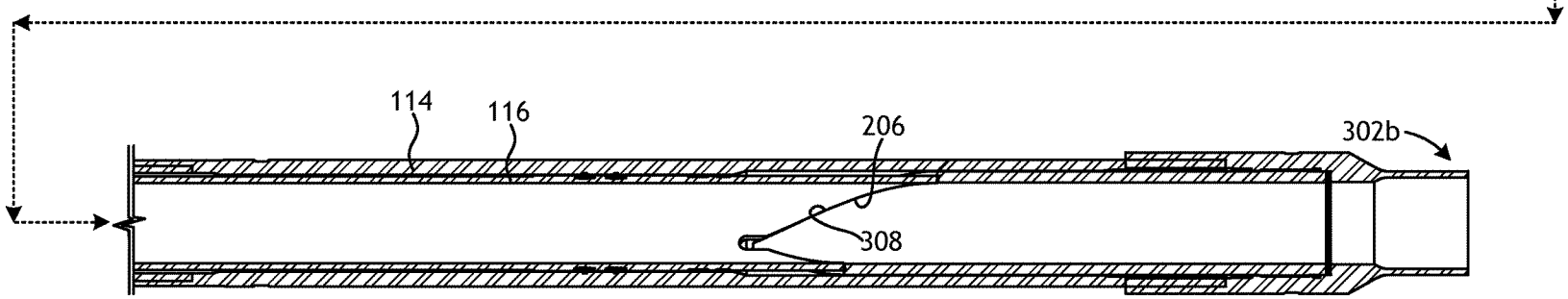

FIGS. 5A-5C are successive cross-sectional side views of the reentry window assembly 112 showing the isolation sleeve 116 moved to the second position, according to one or more embodiments. For space limitations, and because it is not required for the present discussion, sections of the reentry window assembly 112 between FIGS. 5B and 5C are omitted. Similar reference numerals used in prior figures will refer to similar elements or components that may not be described again. Moving the isolation sleeve 116 in the downhole direction (i.e., to the right in FIGS. 5A-5C) within the completion sleeve 114 will eventually expose the window 120 and allow the engagement device 210 to locate and engage the lower coupling 304*b*. Engagement between the engagement device 210 and the lower coupling 304*b* will effectively hold the isolation sleeve 116 in the second position.

As the isolation sleeve 116 moves to the second position, the orienting muleshoe 206 will eventually locate and slidingly engage the muleshoe 308 provided at or near the downhole end 302*b* of the completion sleeve 114. The curved surface of the muleshoe 308 receives and slidingly engages the opposing curved surface of the orienting muleshoe 206 and thereby rotates the sliding sleeve 116 to a desired and predetermined angular orientation as the isolation sleeve 116 moves in the downhole direction. More particularly, the muleshoe 308 may be configured to rotate and angularly align the isolation sleeve 116 with the window 120.

With the isolation sleeve 116 in the second position, the whipstock assembly 400 may be set within the reentry window assembly 112 and, more particularly, within the isolation sleeve 116. To accomplish this, an axial load is applied to the running tool 402 to shear one or more shearable devices 502 (i.e., shear pins, shear screws, a shear ring, etc.) that operatively secure the latch key mandrel 418 within the latch key assembly 406. In some embodiments, the required axial load to shear the shearable device 502 may originate from a jarring tool operatively coupled to the uphole end of the running tool 402. Downward jarring on the running tool 402 will provide downward impulse loads on the actuation mandrel 416, which transfers the impulse loads to the latch key mandrel 418 and the shearable devices 502. In other embodiments, however, the required axial load to shear the shearable device 502 may originate from the conveyance (e.g., drill pipe, coiled tubing, production tubing, etc.) that runs the whipstock assembly 400 downhole.

Once the shearable devices 502 fail under the axial load, further axial loading on the running tool 402 will advance the actuation mandrel 416 and the latch key mandrel 418 in the downhole direction and simultaneously advance the bullnose assembly 404 downhole with respect to the latch key assembly 406. The actuation mandrel 416 may be advanced downhole until a whipstock collet 504 included in the bullnose assembly 404 locates a lower profile 506 defined on the inner radial surface of the isolation sleeve 116 located axially downhole from the engagement device 210. As described above, the actuation mandrel 416 may be advanced downhole until the ball 420 is eventually received within the pocket 426, thereby freeing the actuation mandrel 416 and the running tool 402 from coupled engagement with the whipstock assembly 400.

Figure 6A:
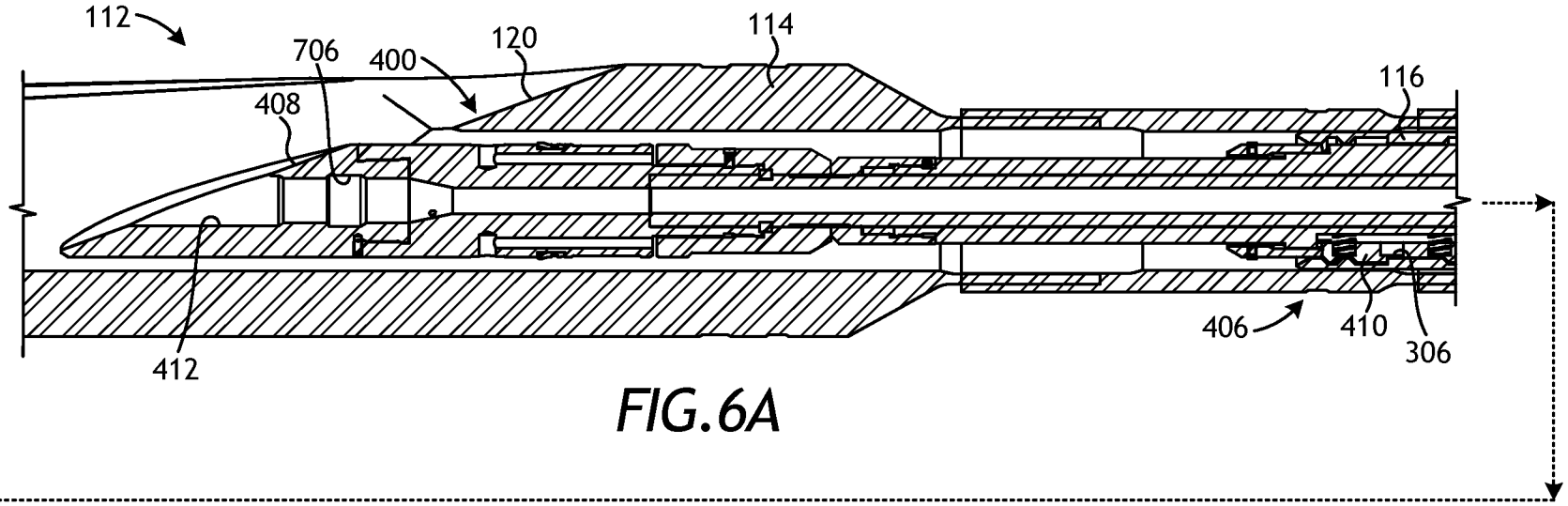
FIGS. 6A and 6B are successive cross-sectional side views of the assembly of FIG. 1 showing the isolation sleeve moved to the second position and the running tool removed from the whipstock assembly following actuation.
Figure 6B:
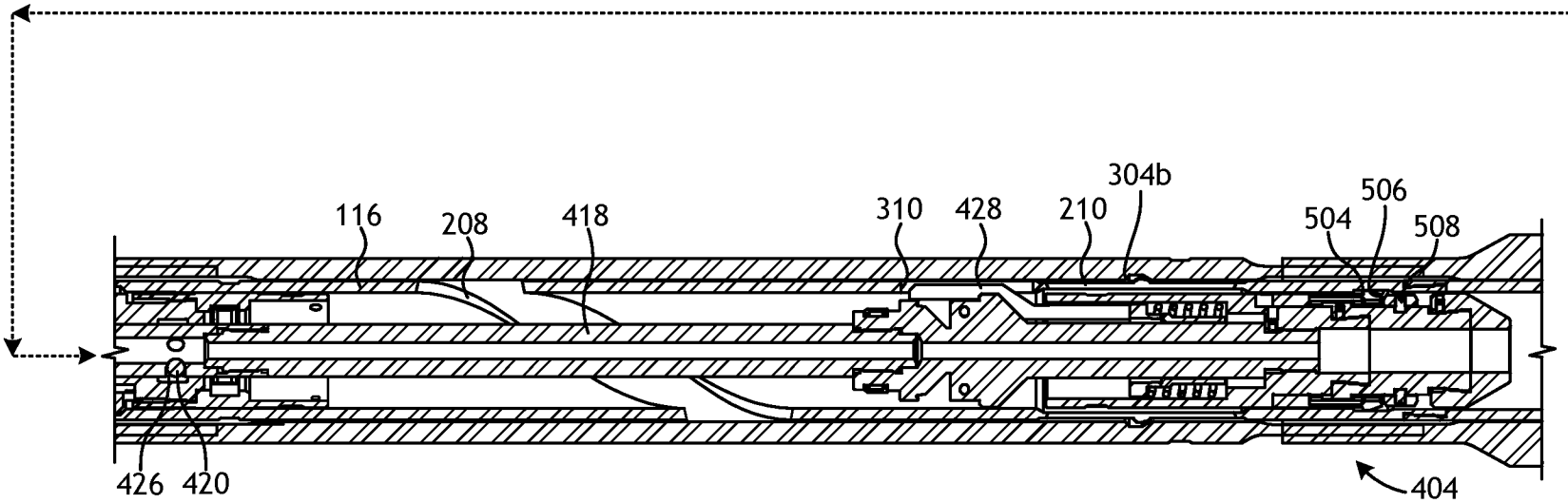

FIGS. 6A and 6B are successive cross-sectional side views of the reentry window assembly 112 showing the isolation sleeve 116 moved to the second position and the running tool 402 removed from the whipstock assembly 400 following actuation, according to one or more embodiments. As illustrated, the latch key mandrel 418 and the bullnose assembly 404 have been advanced in the downhole direction with respect to the latch key assembly 406 until the whipstock collet 504 locates and engages the lower profile 506. Engaging the whipstock collet 504 in the lower profile 506 secures the whipstock assembly 400 within the isolation sleeve 116 for subsequent downhole operations.

As the bullnose assembly 404 advances in the downhole direction with respect to the latch key assembly 406, the orienting key 428 is moved from its stowed configuration and radially expands to its radially extended configuration. In the radially extended configuration, the orienting key 428 is able to locate and extend into the helical slot 208. As the bullnose assembly 404 advances in the downhole direction, the orienting key 428 slidingly engages the helical slot 208 and simultaneously angularly orients the whipstock assembly 400 until reaching the straight portion 310 of the helical slot 208. Once the orienting key 428 reaches the straight portion 310, angular rotation of the whipstock assembly 400 ceases and the whipstock face 408 will be angularly aligned with the window 120 of the completion sleeve 114.

Once free from the whipstock assembly 400 and the whipstock collet 504 is properly engaged with the lower profile 506, the running tool 402 (FIGS. 5A and 5B) may be retracted from the whipstock assembly 400 and pulled back to the surface of the well. Downhole tools (not shown) may then be introduced downhole and advanced into the secondary wellbore 104 (FIG. 1) to undertake a variety of wellbore maintenance operations. More particularly, the downhole tools may be advanced to the reentry window assembly 112 where they are deflected into the secondary wellbore 104 by engaging the whipstock face 408, which deflects the downhole tools into the secondary wellbore 104 through the window 120.

Figure 7:
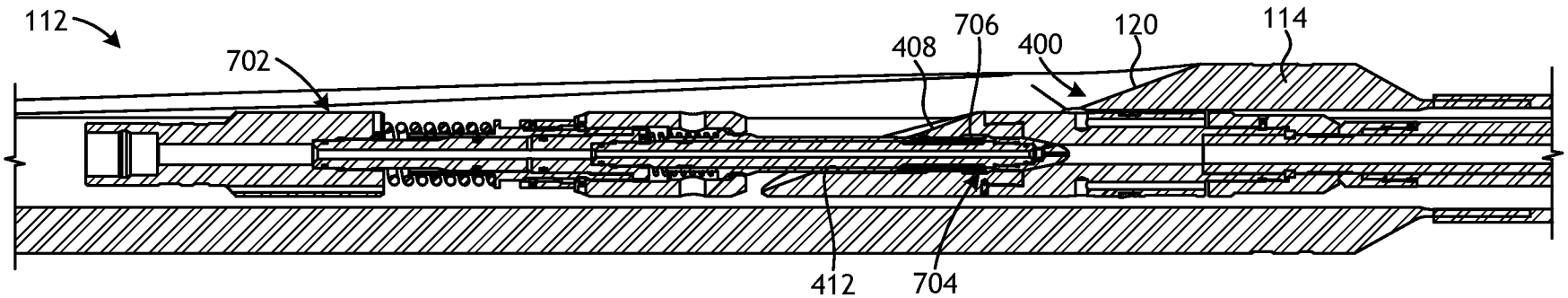
FIG. 7 depicts a cross-sectional side view of a portion of the assembly of FIG. 1 with a retrieving tool engaged with the whipstock assembly of FIG. 4.

FIG. 7 depicts a cross-sectional side view of a portion of the reentry window assembly 112 with a retrieving tool 702 engaged with the whipstock assembly 400, according to one or more embodiments. After performing the desired wellbore maintenance and intervention operations in the secondary wellbore 104 (FIG. 1) via the window 120, the whipstock assembly 400 may be pulled from the reentry window assembly 112 and retrieved from the primary wellbore 102 (FIG. 1). To accomplish this, the retrieving tool 702 is advanced downhole until locating the whipstock assembly 400. The retrieving tool 702 may be conveyed downhole on wireline or coiled tubing and stung into the central passage 412 to couple the retrieving tool 702 to the whipstock assembly 400. As illustrated, the retrieving tool 702 may include a collet 704 or any other engagement mechanism configured to locate and engage an inner groove 706 defined on the inner radial surface of the central passage 412.

Referring again to FIGS. 6A-6B, with continued reference to FIG. 7, once the retrieving tool 702 successfully couples to the whipstock assembly 400 by mating the collet 704 with the inner groove 706, the retrieving tool 702 may then be pulled in the uphole direction (i.e., to the left in FIGS. 6A-6B and 7) to move the isolation sleeve 116 back to the first position. More particularly, an uphole axial load applied by the retrieving tool 702 on the whipstock assembly 400 is transferred to the isolation sleeve 116 and may be of sufficient magnitude to disengage the engagement device 210 from the lower coupling 304*b*. A set of shear screws 508 or other shearable devices positioned on the bullnose assembly 404 may be configured to prevent the collet fingers of the whipstock collet 504 from disengaging the isolation sleeve 116 at the lower profile 506. Accordingly, once the engagement device 210 disengages from the lower coupling 304*b*, the isolation sleeve 116 is then free to axially translate within the completion sleeve 114 in the uphole direction as coupled to the whipstock assembly 400 at the whipstock collet 504.

Figure 8:
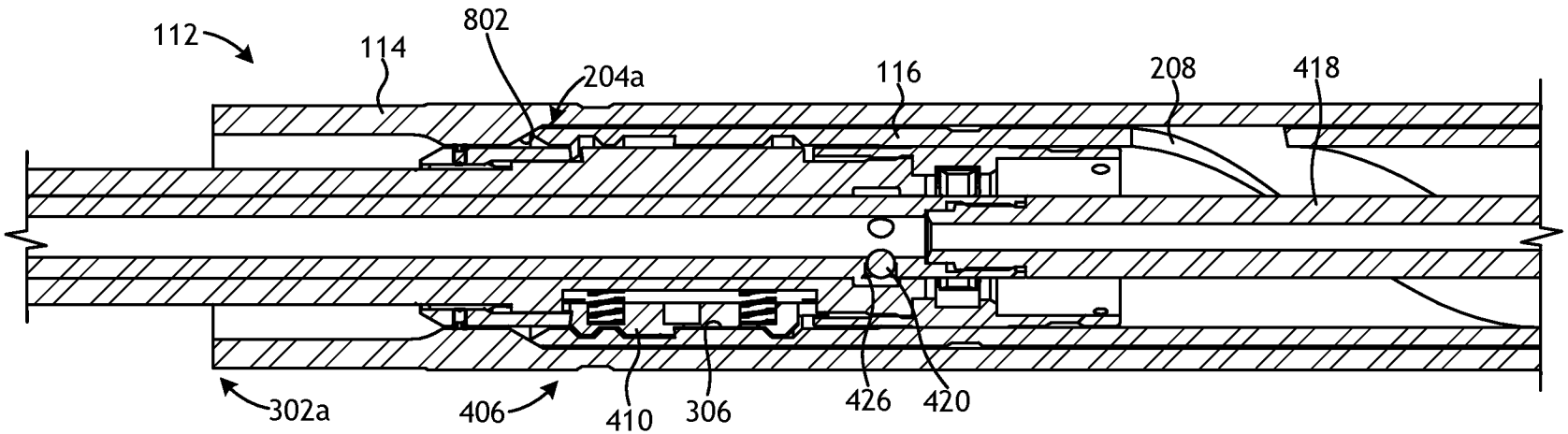
FIG. 8 depicts a cross-sectional side view of a portion of the assembly of FIG. 1 with the isolation sleeve shifted back to the first position.

FIG. 8 depicts a cross-sectional side view of a portion of the reentry window assembly 112 with the isolation sleeve 116 shifted back to the first position, according to one or more embodiments. With the retrieving tool 702 (FIG. 7) coupled to the whipstock assembly 400, as discussed above, the isolation sleeve 116 may be pulled in the uphole direction (i.e., to the left in FIG. 8) to disengage the engagement device 210 (FIG. 6B) from the lower coupling 304*b* (FIG. 6B) and thereby move the isolation sleeve 116 to the closed position, as shown in FIG. 8. In the first position, the engagement device 210 may once again locate and engage the upper coupling 304*a* (FIGS. 3A and 4B). The isolation sleeve 116 may be moved in the uphole direction until the uphole end 204*a* of the isolation sleeve 116 engages a no-go shoulder 802 defined on the inner radial surface of the completion sleeve 114.

The no-go shoulder 802 effectively stops axial movement of the isolation sleeve 116 in the uphole direction, and further axial movement in the uphole direction places an axial load on the shear screws 508 (FIG. 6B) positioned on the bullnose assembly 404 (FIG. 6B). Increasing the uphole axial load on the whipstock assembly 400 with the retrieving tool 702 (FIG. 7) will eventually result in failure of the shear screws 508, which frees whipstock assembly 400 from the isolation sleeve 116 by allowing the whipstock collet 504 (FIG. 6B) to disengage from the lower profile 506 (FIG. 6B). The orienting key 428 (FIG. 6B) may also be moved back to its stowed configuration during this movement. Once the whipstock collet 504 disengages from the lower profile 506, the whipstock assembly 400 may then be free from the reentry window assembly 112 and free to be retracted to the well surface as coupled to the retrieving tool 702.

Those skilled in the art will readily appreciate the advantages that the reentry window assembly 112 provides a well operator. Earlier reentry window assembly designs employ isolation sleeves that must be completely removed from the primary wellbore 102 (FIG. 1) to allow access to the secondary wellbore 104 (FIG. 1). The isolation sleeve 116 of the presently described reentry window assembly 112, however, remains in the primary wellbore 102, and is only shifted between the first (open) and second (closed) positions when running and retrieving the whipstock assembly 400. Accordingly, the isolation sleeve 116 may reduce rig time by eliminating required runs to retrieve and re-install conventional isolation sleeves.

Moreover, the isolation sleeve 116 and presently described reentry window assembly 112, may be particularly advantageous in wells with multiple (stacked) assemblies 112 at corresponding junctions between the primary wellbore 102 (FIG. 1) and the secondary wellbore 104 (FIG. 1). Whereas the isolation sleeves in conventional reentry window assemblies are required to be pulled out of the primary wellbore 102 to access lower secondary wellbores 104, the latch key assembly 406 and associated selective latch key 410 enables the whipstock assembly 400 to bypass isolation sleeves 116 having an inner profile 306 that does not match the unique profile design of the selective latch key 410. This leaves all the other secondary wellbores 104 isolated while the whipstock assembly 400 locates and engages the desired isolation sleeve 116.

Embodiments disclosed herein include:

A. A well system, comprising a primary wellbore defining a casing exit, a secondary wellbore extending from the casing exit, and a reentry window assembly positioned within the primary wellbore and including a completion sleeve that defines a window alignable with the casing exit and upper and lower couplings defined on an inner surface of the completion sleeve on opposing axial ends of the window, and an isolation sleeve positioned within the completion sleeve and defining a helical slot, wherein the isolation sleeve is movable between a first position, where an engagement device engages the upper coupling and the isolation sleeve occludes the window, and a second position, where the isolation sleeve is moved axially within completion sleeve to expose the window and the engagement device engages the lower coupling. The well system further includes a whipstock assembly that includes a whipstock face, a latch key assembly operatively coupled to the whipstock face and providing a latch key that selectively locates and engages an inner profile defined on the isolation sleeve to move the isolation sleeve to the second position, and an orienting key matable with the helical slot to angularly orient the whipstock face to the window as the isolation sleeve moves to the second position.

B. A method that includes advancing a whipstock assembly coupled to a running tool into a primary wellbore that defines a casing exit and has a secondary wellbore extending from the casing exit, coupling the whipstock assembly to an isolation sleeve positioned within a completion sleeve that defines a window aligned with the casing exit, wherein the isolation sleeve occludes the window in a first position within the completion sleeve, moving the isolation sleeve to a second position within the completion sleeve with the whipstock assembly as coupled to the running tool, and thereby exposing the window, detaching the running tool from the whipstock tool with the isolation tool in the second position, deflecting one or more downhole tools into the secondary wellbore off a deflector face of the whipstock assembly, coupling a retrieving tool to the whipstock assembly and moving the isolation sleeve back to the first position with the whipstock assembly as coupled to the retrieving tool, and detaching the whipstock assembly from the isolation sleeve with the isolation sleeve in the first position.

Each of embodiments A and B may have one or more of the following additional elements in any combination: Element 1: further comprising a set of upper seals provided by the isolation sleeve to sealingly engage an upper seal bore defined on the inner surface of the completion sleeve, and a set of lower seals provided by the isolation sleeve to sealingly engage a lower seal bore defined on the inner surface of the completion sleeve, wherein the upper and lower seal bores are located on opposing axial ends of the window. Element 2: wherein the reentry window assembly further includes an orienting muleshoe provided at a downhole end of the isolation sleeve, and a muleshoe provided at a lower end of the completion sleeve, wherein the muleshoe receives and slidingly engages the orienting muleshoe to angularly orient the isolation sleeve with respect to the window as the isolation sleeve moves to the second position. Element 3: wherein the helical slot extends at least 360° about the isolation sleeve and terminates in a straight portion. Element 4: further comprising a running tool coupled to the whipstock assembly to advance the whipstock assembly within the primary wellbore to locate the reentry window assembly and move the isolation sleeve to the second position. Element 5: wherein the whipstock assembly further comprises a bullnose assembly operatively coupled to the latch key assembly and providing a whipstock collet configured to engage a lower profile defined on an inner radial surface of the isolation sleeve and thereby secure the whipstock assembly within the isolation sleeve. Element 6: further comprising one or more shear screws positioned on the bullnose assembly to prevent the whipstock collet from disengaging the isolation sleeve at the lower profile. Element 7: further comprising a retrieving tool engageable with the whipstock assembly to move the isolation sleeve back to the first position and disengage the whipstock assembly from the isolation sleeve. Element 8: wherein the whipstock face defines a central passage and the retrieving tool provides a collet that locates and engages an inner groove defined in the central passage. Element 9: wherein the completion sleeve further defines a no-go shoulder on the inner surface, and wherein the isolation sleeve engages the no-go shoulder upon moving back to the first position.

Element 10: wherein upper and lower couplings are defined on an inner surface of the completion sleeve on opposing axial ends of the window, the method further comprising securing the isolation sleeve in the first position by engaging an engagement device of the isolation sleeve within the upper coupling, and securing the isolation sleeve in the second position by engaging the engagement device of the isolation sleeve within the lower coupling. Element 11: wherein the whipstock assembly includes a latch key assembly operatively coupled to the whipstock face and provides a latch key, and wherein coupling the whipstock assembly to the isolation sleeve comprises selectively locating and engaging an inner profile defined on the isolation sleeve with the latch key. Element 12: wherein the isolation sleeve defines a helical slot and the whipstock assembly provides an orienting key, and wherein moving the isolation sleeve to the second position further comprises mating and slidingly engaging the orienting key within the helical slot, and angularly orienting the whipstock face to the window with the orienting key as the isolation sleeve moves to the second position. Element 13: wherein the isolation sleeve is a first isolation sleeve positioned within a first completion sleeve, and wherein coupling the whipstock assembly to the isolation sleeve is preceded by bypassing a second isolation sleeve positioned within a second completion sleeve arranged uphole from the first completion sleeve within the primary wellbore, wherein bypassing the second isolation sleeve comprises failing to mate a unique profile of the latch key with an inner profile defined on the second isolation sleeve. Element 14: wherein a downhole end of the isolation sleeve provides an orienting muleshoe and a lower end of the completion sleeve provides a muleshoe, and wherein moving the isolation sleeve to the second position further comprises receiving and slidingly engaging the orienting muleshoe with the muleshoe as the isolation sleeve moves to the second position, and angularly orienting the isolation sleeve with respect to the window with the muleshoe. Element 15: wherein the whipstock assembly further comprises a bullnose assembly operatively coupled to the latch key assembly and provides a whipstock collet, the method further comprising engaging the whipstock collet on a lower profile defined on an inner radial surface of the isolation sleeve and thereby securing the whipstock assembly within the isolation sleeve. Element 16: further comprising one or more shear screws positioned on the bullnose assembly, the method further comprising preventing the whipstock collet from disengaging the isolation sleeve at the lower profile with the one or more shear screws. Element 17: wherein detaching the whipstock assembly from the isolation sleeve comprises engaging the isolation sleeve on a no-go shoulder defined on the inner surface of the completion sleeve, and shearing the one or more shear screws to allowing the whipstock collet to disengage from the lower profile and thereby free the whipstock assembly from the isolation sleeve. Element 18: wherein the whipstock face defines a central passage and the retrieving tool provides a collet, and wherein coupling the retrieving tool to the whipstock assembly comprises locating and engaging the collet on an inner groove defined in the central passage.

By way of non-limiting example, exemplary combinations applicable to A and B include: Element 5 with Element 6; Element 7 with Element 8; Element 7 with Element 9; Element 15 with Element 16; and Element 16 with Element 17.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A well system, comprising:

a primary wellbore lined with casing that defines a casing exit;

a secondary wellbore extending from the casing exit;

a reentry window assembly positioned within the primary wellbore and including:

a completion sleeve defining a window alignable with the casing exit and upper and lower couplings provided on an inner surface of the completion sleeve adjacent opposing axial ends of the window; and an isolation sleeve positioned within the completion sleeve and defining a helical slot, the isolation sleeve being movable between a first position, where an engagement device provided on the isolation sleeve engages the upper coupling and the isolation sleeve occludes the window, and a second position, where the isolation sleeve is moved axially within completion sleeve to expose the window and the engagement device engages the lower coupling; and a whipstock assembly comprising:

a whipstock face and an orienting key matable with the helical slot to angularly orient the whipstock face to the window as the isolation sleeve moves to the second position;

a latch key assembly operatively coupled to the whipstock face and providing a latch key that selectively locates and engages an inner profile defined on the isolation sleeve to move the isolation sleeve to the second position; and a bullnose assembly operatively coupled to the latch key assembly and providing a whipstock collet configured to engage a lower profile defined on an inner radial surface of the isolation sleeve and thereby secure the whipstock assembly within the isolation sleeve.

2. The well system of claim 1, further comprising:

a set of upper seals provided by the isolation sleeve to sealingly engage an upper seal bore defined on the inner surface of the completion sleeve; and a set of lower seals provided by the isolation sleeve to sealingly engage a lower seal bore defined on the inner surface of the completion sleeve, wherein the upper and lower seal bores are located on opposing axial ends of the window.

3. The well system of claim 1, wherein the reentry window assembly further includes:

an orienting muleshoe provided at a downhole end of the isolation sleeve; and a muleshoe provided at a lower end of the completion sleeve, wherein the muleshoe receives and slidingly engages the orienting muleshoe to angularly orient the isolation sleeve with respect to the window as the isolation sleeve moves to the second position.

4. The well system of claim 1, wherein the helical slot extends at least 360° about the isolation sleeve and terminates in a straight portion.

5. The well system of claim 1, further comprising a running tool coupled to the whipstock assembly to advance the whipstock assembly within the primary wellbore to locate the reentry window assembly and move the isolation sleeve to the second position.

6. The well system of claim 1, further comprising one or more shear screws positioned on the bullnose assembly to prevent the whipstock collet from disengaging the isolation sleeve at the lower profile.

7. The well system of claim 1, further comprising a retrieving tool engageable with the whipstock assembly to move the isolation sleeve back to the first position and disengage the whipstock assembly from the isolation sleeve.

8. The well system of claim 7, wherein the whipstock face defines a central passage and the retrieving tool provides a collet that locates and engages an inner groove defined in the central passage.

9. The well system of claim 7, wherein the completion sleeve further defines a no-go shoulder on the inner surface, and wherein the isolation sleeve engages the no-go shoulder upon moving back to the first position.

10. A method, comprising:

advancing a whipstock assembly coupled to a running tool into a primary wellbore lined with casing that defines a casing exit and has a secondary wellbore extending from the casing exit;

coupling the whipstock assembly to an isolation sleeve positioned within a completion sleeve defining a window aligned with the casing exit, wherein the isolation sleeve occludes the window in a first position within the completion sleeve;

moving the isolation sleeve to a second position within the completion sleeve and thereby exposing the window;

detaching the running tool from the whipstock tool assembly with the isolation sleeve in the second position;

coupling a retrieving tool to the whipstock assembly and moving the isolation sleeve back to the first position; and detaching the whipstock assembly from the isolation sleeve with the isolation sleeve in the first position.

11. The method of claim 10, wherein upper and lower couplings are provided on an inner surface of the completion sleeve adjacent opposing axial ends of the window, the method further comprising:

securing the isolation sleeve in the first position by mating an engagement device of the isolation sleeve with the upper coupling; and securing the isolation sleeve in the second position by mating the engagement device with the lower coupling.

12. The method of claim 10, wherein the whipstock assembly includes a latch key assembly operatively coupled to a whipstock face of the whipstock assembly and provides a latch key, and wherein coupling the whipstock assembly to the isolation sleeve comprises selectively locating and engaging an inner profile defined on the isolation sleeve with the latch key.

13. The method of claim 10, wherein the isolation sleeve defines a helical slot and the whipstock assembly provides an orienting key, and wherein moving the isolation sleeve to the second position further comprises:

mating and slidingly engaging the orienting key within the helical slot; and angularly orienting a whipstock face of the whipstock assembly to the window with the orienting key as the isolation sleeve moves to the second position.

14. The method of claim 13, wherein the isolation sleeve is a first isolation sleeve positioned within a first completion sleeve and coupling the whipstock assembly to the isolation sleeve is preceded by:

bypassing a second isolation sleeve positioned within a second completion sleeve arranged uphole from the first completion sleeve within the primary wellbore, wherein bypassing the second isolation sleeve comprises failing to mate a unique profile of a latch key of the whipstock assembly with an inner profile defined on the second isolation sleeve.

15. The method of claim 10, wherein a downhole end of the isolation sleeve provides an orienting muleshoe and a lower end of the completion sleeve provides a muleshoe, and wherein moving the isolation sleeve to the second position further comprises:

receiving and slidingly engaging the orienting muleshoe with the muleshoe as the isolation sleeve moves to the second position; and angularly orienting the isolation sleeve with respect to the window with the muleshoe.

16. The method of claim 10, wherein the whipstock assembly further comprises a latch key assembly and a bullnose assembly operatively coupled to the latch key assembly and providing a whipstock collet, the method further comprising:

engaging the whipstock collet on a lower profile defined on an inner radial surface of the isolation sleeve and thereby securing the whipstock assembly within the isolation sleeve.

17. The method of claim 16, further comprising one or more shear screws positioned on the bullnose assembly, the method further comprising preventing the whipstock collet from disengaging the isolation sleeve at the lower profile with the one or more shear screws.

18. The method of claim 17, wherein detaching the whipstock assembly from the isolation sleeve comprises:

engaging the isolation sleeve on a no-go shoulder defined on an inner surface of the completion sleeve; and shearing the one or more shear screws to allowing the whipstock collet to disengage from the lower profile and thereby free the whipstock assembly from the isolation sleeve.

19. The method of claim 10, wherein a whipstock face of the whipstock assembly defines a central passage and the retrieving tool provides a collet, and wherein coupling the retrieving tool to the whipstock assembly comprises locating and engaging the collet on an inner groove defined in the central passage.

* * * * *